US005819507A

United States Patent [19]

Kaneko et al.

[11] Patent Number: 5,819,507

[45] Date of Patent: Oct. 13, 1998

[54] METHOD OF FILLING A PACKAGING CONTAINER

[75] Inventors: Masamichi Kaneko, Tokyo; Hidetoshi Konno, Kanagawa; Junichi Satoyoshi, Tokyo, all of Japan

[73] Assignee: Tetra Laval Holdings & Finance S.A., Pully, Switzerland

[21] Appl. No.: 849,229

[22] PCT Filed: Dec. 5, 1995

[86] PCT No.: PCT/US95/15751

§ 371 Date: Aug. 1, 1997

§ 102(e) Date: Aug. 1, 1997

[87] PCT Pub. No.: WO96/17772

PCT Pub. Date: Jun. 13, 1996

[30] Foreign Application Priority Data

Dec. 5, 1994 [JP] Japan ..... 6-301049

[51] Int. Cl.[6] ..... B65B 3/04; B65B 61/24

[52] U.S. Cl. ..... 53/473; 53/486; 53/487

[58] Field of Search ..... 53/486, 487, 289, 53/290, 319, 320, 422, 421, 420, 473, 488, 489, 113, 526, 527, 523

[56] References Cited

U.S. PATENT DOCUMENTS

| | | | |
|---|---|---|---|
| 3,625,786 | 12/1971 | Pearson et al. | 53/486 X |
| 4,338,765 | 7/1982 | Ohmori et al. | 53/486 X |
| 4,680,917 | 7/1987 | Hambleton et al. | 53/487 X |
| 4,967,538 | 11/1990 | Leftault, Jr. et al. | 53/436 X |
| 5,060,453 | 10/1991 | Alberghini et al. | 53/486 X |
| 5,137,171 | 8/1992 | Goeppner | 53/486 X |

*Primary Examiner*—James F. Coan

*Attorney, Agent, or Firm*—Burns, Doane, Swecker & Mathis, L.L.P.

[57] ABSTRACT

In a method of filling a packaging container, a liquid is charged in a container through an opening in a top end of the container to a first level below the top end of the container. The container has a deformable portion in a wall thereof so that an inside volume of the container can be adjusted. A lid is sealed on the opening, and the deformable portion of the container is deformed to elevate the liquid above the first level.

14 Claims, 8 Drawing Sheets

METHOD OF FILLING A PACKAGING CONTAINER

FIELD OF THE INVENTION

This invention relates to a method of filling a packaging container.

BACKGROUND AND SUMMARY

Conventional packaging containers formed of a resin are often charged with a liquid, e.g., a liquid food, and the filled container is then sealed with a lid. A filling apparatus of a rotary type is generally used for this purpose. Such filling apparatus include a turntable on which the container is placed and is displaced by rotation of the turntable. The filling apparatus also includes a charging station and a sealing station. In the charging station, a liquid food is charged in the container through a top opening of the container. In the sealing portion, the top end of the container is sealed with a lid.

The container on the turntable, after having been filled with the liquid food in the charging station, is displaced to the sealing station with the top end remaining opened. Since the turntable rotates at a relatively high speed to accelerate the filling operation, the liquid food contained in the container is sometimes spilled from the opening due to vibration, etc.

To avoid spillage and related problems, it is a general practice to use a container having a top end that is located at a predetermined height above the level of the liquid food charged in the container so that a head space is defined in an upper portion of the container. It is typical to use an intruding lid member, i.e., a lid having a portion that intrudes into the packaging container to effect full filling.

In the above-described conventional method for filling a packaging container, however, a high charging accuracy is required to perform the full filling. Additionally, in sealing the container with the intruding lid member in the full filled state, the pressure inside the container is increased by the liquid food which is urged to overflow. Moreover, during sealing with the intruding lid member, the resin forming the container is often melted so that the volume of the container is reduced. This also results in the increase of the internal pressure of the container. As a consequence, great forces are imposed on the sealed portion and the rest of the container.

It is an object of the present invention to provide a method of filling a packaging container which can solve the above-mentioned problems of the conventional packaging container filling method, which can reduce costs, and which does not cause excessive force to be applied to the sealed portions and to the whole of the container.

According to an aspect of the present invention, in a method of filling a packaging container, a liquid food is charged in a container formed of a resin, the container having an opening at a top end thereof and a deformable portion in a wall thereof such that the inside volume thereof can be adjusted, a lid is placed on the top end of the container, and a sealing device is lowered from a position above the lid to seal the upper end of the container with the lid.

According to another aspect of the invention, during sealing, the deformable portion of the container is deformed to elevate the surface of the liquid food to a level adjacent to the top end of the container.

When the container according to the present invention is disposed at a filling station of a turntable and is filled with, e.g., a liquid food, and the deformable portion has not been deformed to decrease the volume of the container, e.g., by pushing upward on a deformable portion in a bottom portion of the container, a space is defined between the liquid level of the liquid food and the top end of the container. The container is then displaced on the turntable to a sealing station where the top end of the container is sealed with the lid. Since the space defined between the liquid level of the liquid food and the top end of the container is retained during the displacement of the container from the filling station to the sealing station, the liquid food does not overflow from the opening by vibration, etc. even when the turntable is rotated at a relatively high speed. As a consequence, the overall filling operation can be performed at a high speed.

In the sealing stage, the deformable portion is deformed. e.g., pushed upward, and thereby elevates the level of the liquid food to a level adjacent to the top end of the container, and is also urged in the opposite direction, e.g., downward, as the container is sealed with the lid. However, since a negative pressure is created in the container, the deformable portion is maintained in the deformed position, e.g., the bottom portion is maintained in the upwardly displaced position. When the container is not completely sealed with the lid, the negative pressure in the container is lost so that the deformable portion is moved to the undeformed position, e.g., the bottom portion is moved to a lowered position. Thus, whether the container is properly sealed can be determined by checking whether or not the deformable portion is in the deformed position, e.g., the bottom portion is in the upwardly displaced position. Further, the creation of the negative pressure in the container can prevent an excessive force to be applied to the sealed portion and to the container upon the sealing of the lid to the container, such as where resins are fused.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 2:
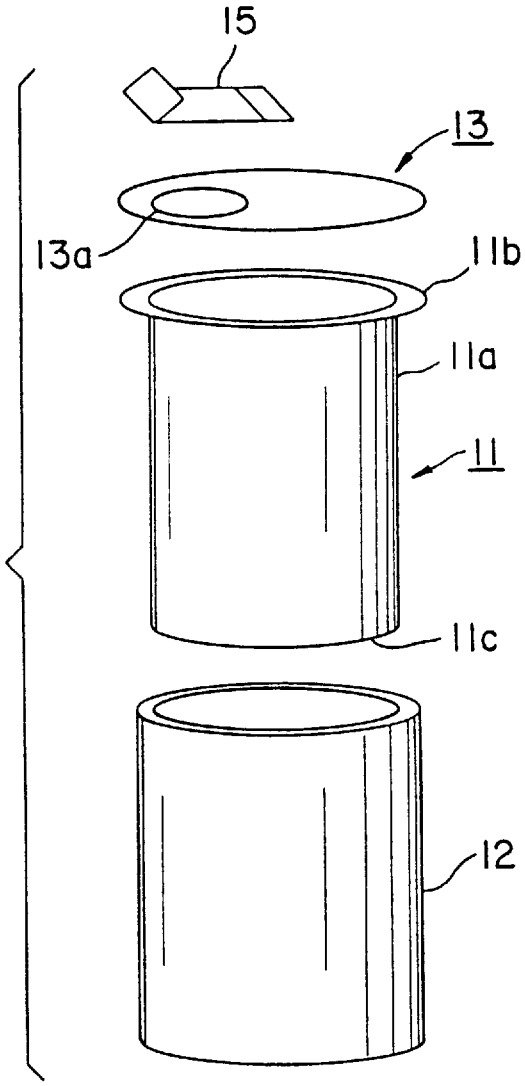
FIG. 2 is an exploded, perspective view of a packaging container according to an embodiment of the present invention.
Figure 3:
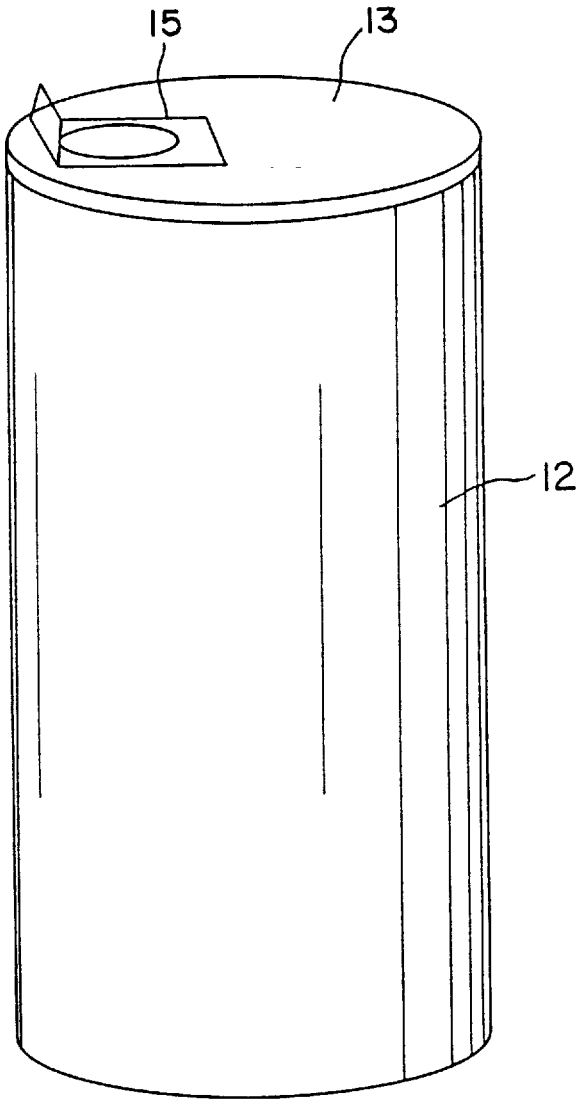
FIG. 3 is a perspective view of a packaging container according to an embodiment of the present invention.
Figure 4:
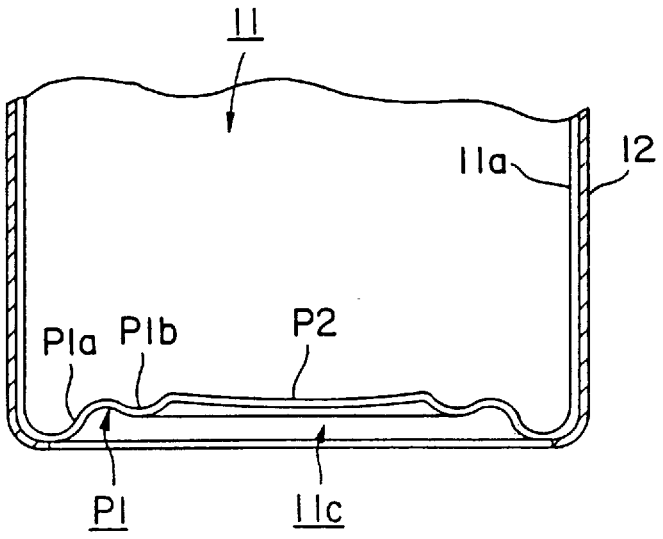
FIG. 4 is a sectional view of a bottom portion of a packaging container according to an embodiment of the present invention, in which a deformable portion is formed in the bottom portion.

A packaging container according to a preferred embodiment of the present invention is shown in FIGS. 2–4 and includes a container 11 that may be used for containing, e.g, a liquid food. The container 11 is preferably formed of a transparent thermoplastic material having good gas barrier properties and having a cup-like shape which is open at its upper end. The container 11 is preferably formed by deforming a multilayer resin sheet by a tip expanding method (Cuspation Dilation forming method) involving thermal molding of the sheet into the cup-like shape. The container 11 is preferably bonded to a substantially cylindrical sleeve 12 during the tip expansion forming of the container. The multilayer sheet is formed by an appropriate method such as coextrusion molding, blown film molding. etc. The container 11 is preferably composed of a body portion 11*a* having a cylindrical cross-section, a radially outwardly extending flange portion 11*b* provided at an upper end of the body portion 11*a* and a bottom portion 11*c* formed at a lower end of the body portion 11*a*. The container 11 preferably has a wall provided with a deformable portion so that the inside volume thereof can be changed. In the embodiment shown in FIG. 4, the bottom portion 11*c* includes a bellows portion P1 formed at a position adjacent to the lower end of the body portion 11*a* and a flat portion P2 formed at a position radially inward of the bellows portion P1. Thus, by deforming the bellows portion P1, the inside volume of the container 11 may be changed.

The bellows portion P1 includes curved wave forms P1*a* and P1*b* which extend obliquely such that the curved wave form on the radially inward side is positioned at a level higher than the radially outward side wave form. As a consequence, when sealing of the container 11 with a lid 13 is completed, the position of the flat portion P2 is higher than that of the lower end of a sleeve 12 defining a lowest point of the packaging container. Therefore, when the packaging container is placed on a table (not shown) or other flat surface, there is defined a heat insulating space between the bottom portion 11*c* and the table.

In the above-described tip expansion method, the multilayer sheet is preferably molded after having been heated to about 180° C., which is higher than the melting point of at least one layer of the sheet. It is therefore not necessary to sterilize the container 11 before filling the liquid food therein. Further, the container 11 is not shrunk or deformed due to molecular orientation during the retort stage. The thermal molding method is any suitable method such as a vacuum blow molding method or a pressure blow molding method. The structure of the multilayer sheet may be, for example, as shown below:

PP(polypropylene)/adhesive layer/EVOH (copolymer of ethylene vinyl alcohol)/adhesive layer/regenerated PP.

Alternatively, the following structures may also be adopted:

PP/regenerated PP/adhesive layer/EVOH/adhesive layer/regenerated PP/PP;

PP/regenerated PP/adhesive layer/EVOH/adhesive layer/APET (amorphous polyethylene teraphthalate);

EVA/EVOH/EVA;

PS (polystyrene)/EVOH/PE(polyethylene);

PS/EVOH/PS;

PP/EVOH/PP.

The use of EVOH in the layer structure can improve the gas barrier property of the multilayer sheet. The following layer structures may also be adopted:

PS/PE;

PS/PETG(APET);

PS/PE/PS.

The sleeve 12, which is preferably formed of a material having greater rigidity and a better heat insulating properties than the container 11 is preferably provided around the outer side of the container 11. The sleeve 12 has a cylindrical shape and serves to retain the shape of the container 11 and to function as a heat insulator for preventing heat transfer between the liquid food contained in the container 11 and the outside atmosphere.

The container 11 and the sleeve 12 form a double wall structure. The sleeve 12 is preferably first prepared and the container 11 is then formed by the tip expansion method within the sleeve 12. The liquid food is then filled in the container 11 and the container is sealed with the lid 13. Alternatively, the container 11 may be first formed by a thermal molding method and then be fitted into the sleeve 12. The liquid food is then filled in the container 11 and the container is sealed with the lid 13. Further, the container 11 may be first formed by a thermal molding method, the liquid food may then be filled in the container 11, the container may then be sealed with the lid 13, and the container may then be fitted into the sleeve 12.

The sleeve 12 is preferably formed of expanded polypropylene. The diameter of pores formed by expansion is about 150 $\mu$m. According to another embodiment, the expanded polypropylene may be substituted by a laminate having a polypropylene layer and an expanded polypropylene layer or by a paper material. In this case, printing may be provided on the surface of the polypropylene layer or paper material. The sleeve 12 is preferably formed of a transparent material so that the liquid food contained in the container 11 can be viewed.

After the liquid food has been filled in the container 11, the lid 13 is fixed on the upper surface of the flange portion 11*b* by sealing means such as heat sealing or ultrasonic sealing to seal the container 11. The resin film constituting the lid member 13 is preferably molded by the coextrusion method or the blown film molding method to have a thickness of 30–50 $\mu$m. The layer structure of the resin film is preferably formed by the coextrusion method may be, for example, as follows:

PP/adhesive layer/EVOF/adhesive layer/PP.

The lid 13 may, according to another embodiment, be in the form of a transparent resin plate having a high gas barrier property. Such a resin plate may be formed by a suitable method such as molding by a hot press method, an injection molding method or the like.

A pour opening 13*a* for pouring the liquid food contained in the container 11 therethrough is formed in a predetermined portion of the lid 13 and is sealed with a pull tab 15. The pull tab 15 is preferably formed of a material having good gas barrier properties and high rigidity and tensile strength. The pull tab 15 may be colored. The layer structure of the pull-tab 15 may be, for example, as follows:

Biaxially oriented PP/peelable adhesive layer.

On an outer surface of the sleeve 12, a glossy film 16 formed of a heat-shrinkable material is preferably provided. The film is printed with desired letters and patterns. The film 16 is preferably a stretched PP film having a thickness of less than 20 $\mu$m. When prints are formed on the surface of the sleeve 12, the film is not required.

The packaging container according to one embodiment has a double wall structure composed of the container 11 and the sleeve 12, however, the packaging container may be formed by the container 11 only if desired.

Figure 1:
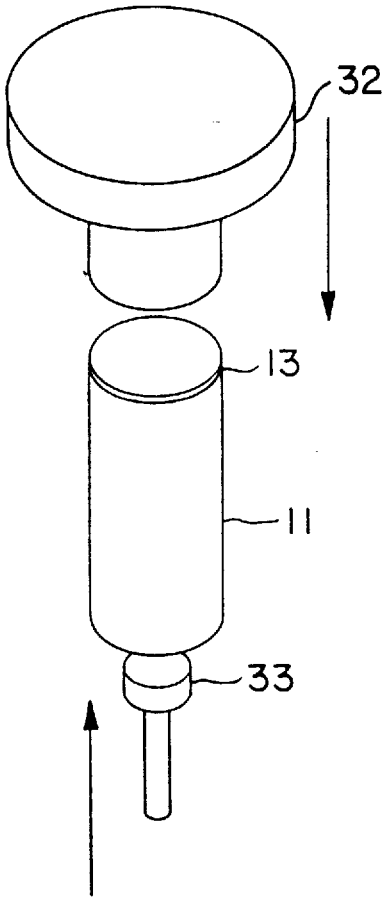
FIG. 1 is a perspective view of a step of sealing a container with a lid according to a first embodiment of the present invention.
Figure 5:
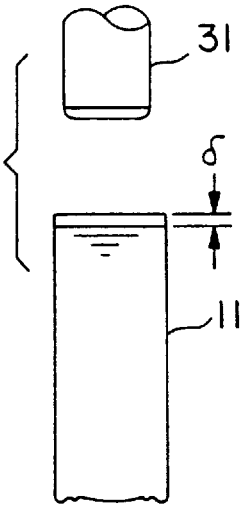
FIG. 5 is a view of a liquid food charging step according to the first embodiment of the present invention.
Figure 6:
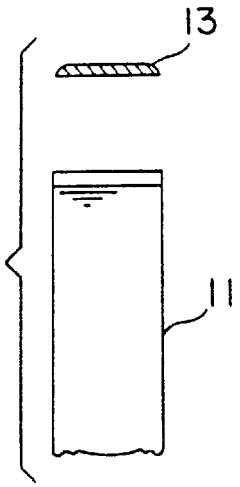
FIG. 6 is a partially sectional view of a lid setting step according to the first embodiment of the present invention.
Figure 8:
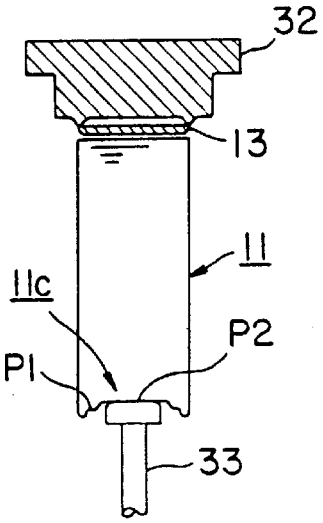
FIG. 8 is a partially sectional view of a second stage of the step of sealing with the container with the lid according to the first embodiment of the present invention.
Figure 7:
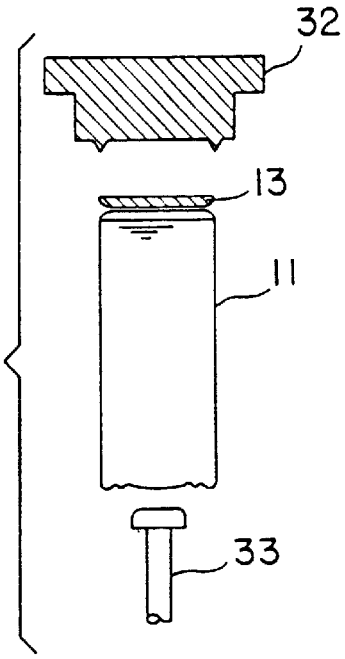
FIG. 7 is a partially sectional view of a first stage of the step of sealing the container with the lid according to the first embodiment of the present invention.
Figure 9:
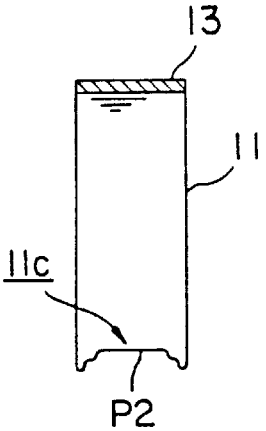
FIG. 9 is a partially sectional view of a container according to the first embodiment of the present invention.

A method of filling a packaging container according to the present invention is seen with reference to FIGS. 1 and 5–9. FIG. 1 shows a step of sealing a container 11 with a lid 13 according to a first embodiment of the present invention. FIG. 5 shows a liquid food charging step according to the first embodiment of the present invention. FIG. 6 shows a lid setting step according to the first embodiment of the present invention. FIG. 7 shows the first stage of the step of sealing the container with the lid according to the first embodiment of the present invention. FIG. 8 shows the second stage of the step of sealing the container with the lid according to the first embodiment of the present invention. FIG. 9 is a sectional view of a container in the first embodiment of the present invention. For convenience of explanation, the sleeve 12 (FIG. 2) is not illustrated in the Figures showing the steps in the performance of the method.

According to the method, the container 11 is fed to a feeding station of a turntable (not shown) and is transferred to a charging station by the rotation of the turntable. As shown in FIG. 5, in the charging station, a feeding pipe 31 of a charger (not shown) for feeding a measured amount of liquid food to the container 11 is disposed above the container. The liquid food is preferably charged so that there is defined a space $\delta$ between the liquid level and an upper end of the container 11.

The container is then transferred to a lid setting station where a lid applicator (not shown) operates to set a lid 13 above the container 11 as shown in FIG. 6.

Subsequently, the container 11 is transferred to a sealing station where, as shown in FIG. 7, the lid 13 is placed on an upper edge (preferably the flange portion 11*b* as seen in FIG. 2) of the container 11, or the sleeve 12, if provided. In the sealing station, a sealing device 32 is disposed above the lid 13 and a pusher 33 is disposed beneath the lid 13. During the passage of the container from the charging station to the seal setting station, the head space is defined in the upper part of the container so that, even when the turntable is rotated at a relatively high speed, the overflowing of the liquid food contained therein from the opening due to vibration, etc. is prevented. Thus, the filling operation can be performed at a high speed.

The sealing device 32 is then lowered, as shown in FIGS. 1 and 8, to press the peripheral edge of the lid 13 to an upper edge of the container 11 and to seal the container 11 with the lid 13. In this case, the pusher 33 is moved upward to push the flat portion P2 of the bottom portion 11*c* of the container 11. Thus, the bellows portion P1 is extended to move the flat portion P2 upward, so that the liquid level of the liquid food is elevated to the upper end of the container 11.

The sealing device is then moved upward and the pusher 33 is moved downward, whereby the sealing of the container 11 with the lid 13 is completed as shown in FIG. 9. Upon moving the pusher 33 downward, the flat portion P2 of the bottom portion 11*c* is urged to move downward. However, since the container 11 is sealed with the lid and a negative pressure is generated within the container 11, the flat portion P2 is maintained in the upwardly displaced position. When, however, the sealing of the container 11 with the lid 13 is not perfect, the negative pressure within the container 11 is not established so that the flat portion P2 is displaced downward. Therefore, by checking whether or not the flat portion P2 is maintained in the upwardly displaced position, it is possible to determine whether or not the sealing of the container is appropriate.

Because of the generation of the negative pressure within the container 11, an excessive force is prevented from acting on the sealed portion and on the container during the melting of the resin forming the lid or the container during sealing.

Figure 10:
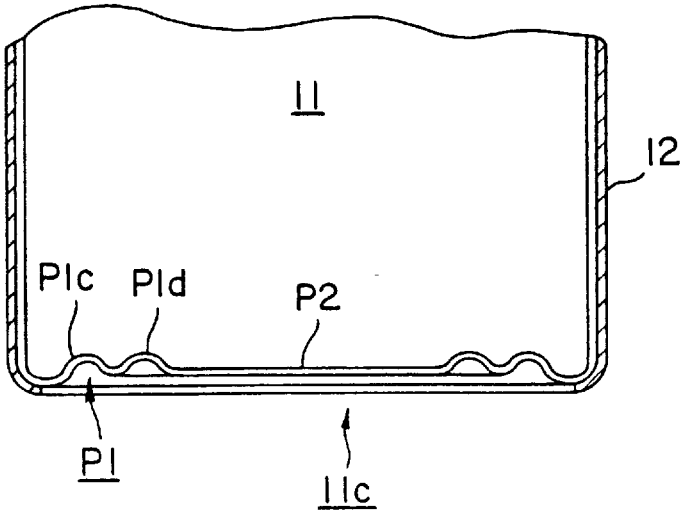
FIG. 10 is a sectional view of a bottom portion of a packaging container according to a second embodiment of the present invention.
Figure 11:
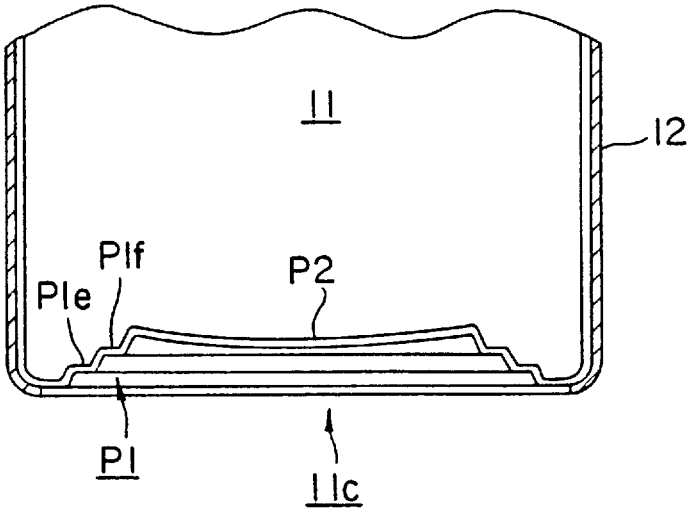
FIG. 11 is a sectional view of a bottom portion of a packaging container according to a third embodiment of the present invention.
Figure 12:
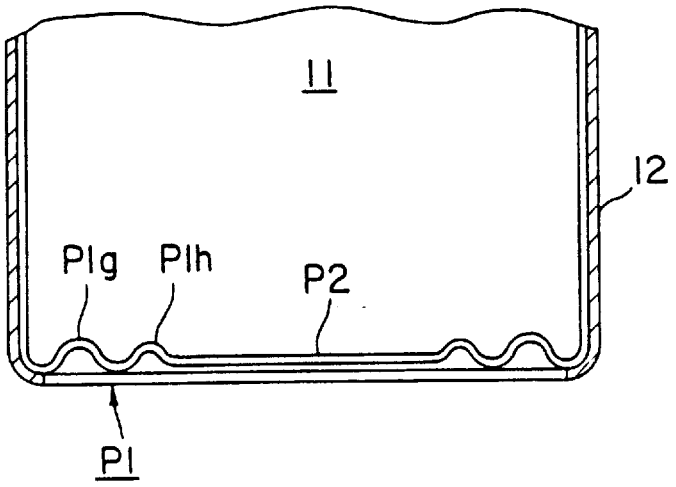
FIG. 12 is a sectional view of a bottom portion of a packaging container according to a fourth embodiment of the present invention.
Figure 13:
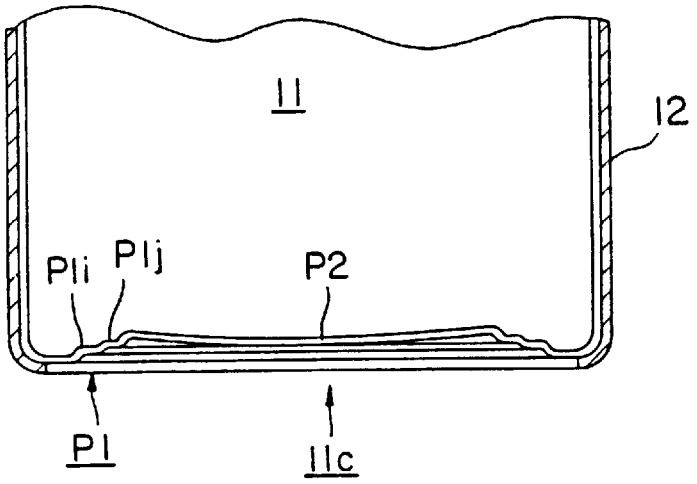
FIG. 13 is a sectional view of a bottom portion of a packaging container according to a fifth embodiment of the present invention.

FIG. 10 shows a bottom portion of a packaging container of a second embodiment of the present invention, FIG. 11 is a sectional view of a bottom portion of a packaging container of a third embodiment of the present invention, FIG. 12 is a sectional view of a bottom portion of a packaging container of a fourth embodiment of the present invention and FIG. 13 is a sectional view of a bottom portion of a packaging container of a fifth embodiment of the present invention. In the second embodiment, as shown in FIG. 10, the bellows portion P1 includes a plurality of curved wave forms P1*c* and P1*d* which extend obliquely such that the curved wave form on the radially inward side is positioned at a level slightly higher than the outward side one. As a consequence, when the sealing of the container 11 with the lid 13 (FIG. 2) is completed, the position of the flat portion P2 is slightly higher than that of the lower end of a sleeve 12. Therefore, when the packaging container is placed on a table or other flat surface, there is defined a heat insulating space between the bottom portion P1*c* and the table.

In the third embodiment, as shown in FIG. 11, the bellows portion P1 includes a plurality of saw teeth wave forms P1*e* and P1*f* which extend obliquely such that the saw tooth wave form on the radially inward side is positioned at a level higher than the outward side one. As a consequence, when the sealing of the container 11 with the lid 13 is completed, the position of the flat portion P2 is higher than that of the lower end of a sleeve 12. Therefore, when the packaging container is placed on a table or other flat surface, there is defined a heat insulating space between the bottom portion 11*c* and the table.

In the fourth embodiment, as shown in FIG. 12, the bellows portion P1 includes a plurality of curved wave forms P1*g* and P1*h* which extend horizontally in the radially inward direction. As a consequence, when the sealing of the container 11 with the lid 13 (FIG. 2) is completed, the height of the flat portion P2 is nearly the same as that of the lower end of a sleeve 12. Therefore, the packaging container may be placed on a table or other flat surface in a stable state.

In the fifth embodiment, as shown in FIG. 13, the bellows portion P1 includes a plurality of saw teeth wave forms P1*e* and P1*j* which extend obliquely such that the saw tooth wave form on the radially inward side is positioned at a level slightly higher than the outward side one. As a consequence, when the sealing of the container 11 with the lid 13 is completed, the position of the flat portion P1 is slightly higher than that of the lower end of a sleeve 12. Therefore, when the packaging container is placed on a table or other flat surface, there is defined a heat insulating space between the bottom portion 11*c* and the table.

Figure 14A:
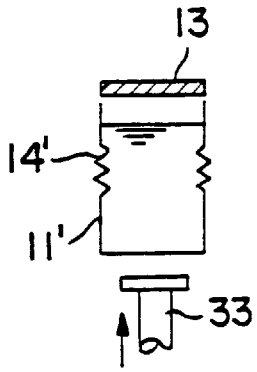
FIGS. 14A–14C, 15A–15C, and 16A–16C are schematic views of steps in the method of filling a packaging container according to embodiments of the present invention in which packaging container according to different embodiments of the invention are filled.
Figure 14B:
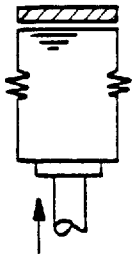
Figure 14C:
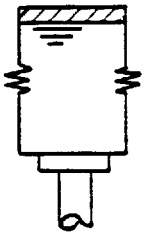
Figure 15A:
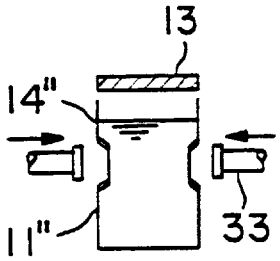
Figure 15B:
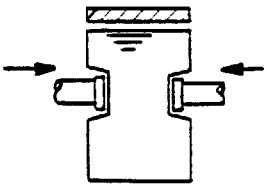
Figure 15C:
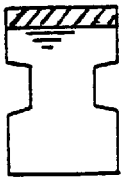
Figure 16A:
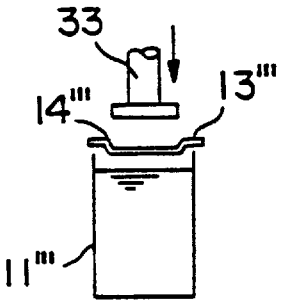
Figure 16B:
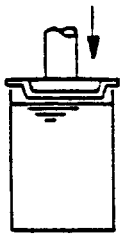
Figure 16C:
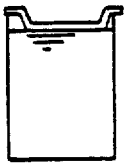

FIGS. 14A–14C illustrate steps in sealing of a container 11' in which the container has a deformable portion 14' in the side wall. FIG. 15 illustrate steps in sealing of a container 11" in which the container has a deformable portion 14" in the side wall. FIG. 16 illustrate steps in the sealing of a container 11"' in which the lid 13"' has a deformable portion 14"'. As with the embodiment of the invention discussed with regard to FIGS. 1 and 5–9, the methods of sealing a container shown in FIGS. 14A–14C, 15A–15C, and 16A–16C all involve a first step (not shown) of filling a container to a level below the top of the container at a filling station, moving the container to a sealing station where a lid is positioned above the container (FIGS. 14A, 15A, and 16A), deforming the deformable portions of the packaging containers so that the liquid level in the containers is raised (FIGS. 14B, 15B, and 16B), and sealing the lids to the containers (FIGS. 14C, 15C, and 16C).

The present invention is not limited to the foregoing embodiments but can be modified in various ways on the basis of the gist of the present invention. These modifications are not excluded from the scope of the present invention.

What is claimed is:

1. A method of filling a packaging container comprising the steps of:

charging a liquid in a container through an opening at a top end of the container to a first level below the top end of the container, the container having a wall portion that is deformable and restorable so that the container is able to assume a deformed condition in which the wall portion is deformed and is restorable towards an undeformed condition in which the wall portion is undeformed to permit adjustment of an inside volume of the container;

deforming the deformable wall portion of the container to elevate the liquid above the first level; and sealing a lid on the opening of the container while the deformable wall portion is deformed, with a negative pressure being created in the container after the lid is sealed to the container.

2. The method as set forth in claim 1, wherein the deforming step is performed during the sealing step.

3. The method as set forth in claim 1, wherein the deforming step is performed before the sealing step.

4. The method as set forth in claim 1, wherein the container is deformed to elevate the liquid to the top end of the container.

5. The method as set forth in claim 1, wherein, during the deforming step, a deforming member contacts a portion of the container to deform the deformable portion.

6. The method as set forth in claim 5, wherein the deforming member contacts a bottom portion of the container to deform the deformable portion in a bottom wall of the container.

7. The method as set forth in claim 5, wherein the deforming member contacts a bottom portion of the container to deform the deformable portion in a side wall of the container.

8. The method as set forth in claim 5, wherein the deforming member contacts a side portion of the container to deform the deformable portion in a side wall of the container.

9. The method as set forth in claim 1, wherein the container is attached to a sleeve having a bottom end, and the deformable portion includes a substantially flat portion and a bellows portion, the flat portion and the bellows portion being at substantially a level of the bottom end of the sleeve prior to deformation of the deformable portion.

10. The method as set forth in claim 9, wherein the flat portion and bellows portions are arranged such that, when the lid is sealed on the container, the flat portion is above the bottom end of the sleeve.

11. The method as set forth in claim 9, wherein the flat portion and the bellows portion are arranged such that, when the lid is sealed on the container, the flat portion is at substantially the level of the bottom of the sleeve.

12. A method of filling a packaging container comprising the steps of:

charging a liquid in a container through an opening at a top end of the container to a first level below the top end of the container;

deforming a deformable and restorable portion of a lid to move the deformable portion of the lid towards the first level; and sealing the lid to the container at the opening while the deformable and restorable portion of the lid is deformed to cover the opening in the container, with a negative pressure being created within the container after the lid is sealed to the container.

13. The method as set forth in claim 12, wherein the deforming step is performed during the sealing step.

14. The method as set forth in claim 12, wherein the deforming step is performed before the sealing step.

* * * * *